United States Patent [19]

Rogers et al.

[11] 4,204,421

[45] May 27, 1980

[54] LAMINATED BOARD AND HAMMER COMBINATION FOR A DROP HAMMER FORGE

[75] Inventors: Thomas E. Rogers; Richard J. Rogers; Peter T. Rogers; James G. Rogers, all of Marion, Wis.

[73] Assignee: Marion Plywood Corporation, Marion, Wis.

[21] Appl. No.: 846,164

[22] Filed: Oct. 27, 1977

[51] Int. Cl.[2] ..... B21J 7/36

[52] U.S. Cl. ..... 72/439; 156/299; 173/90; 428/106; 428/114; 428/332; 428/526; 428/535

[58] Field of Search ..... 428/106, 114, 213, 214, 428/535, 332; 72/439, 435; 156/228, 281, 313, 299; 173/90, 124, 92; 100/214

[56] References Cited

U.S. PATENT DOCUMENTS

| | | | |
|---|---|---|---|
| 255,619 | 3/1882 | Hague | 72/439 |
| 1,722,715 | 7/1929 | Teakle | 72/439 |
| 2,158,834 | 5/1939 | Robinson | 72/439 |

*Primary Examiner*—George F. Lesmes
*Assistant Examiner*—P. Thibodeau
*Attorney, Agent, or Firm*—Hill, Van Santen, Steadman, Chiara & Simpson

[57] ABSTRACT

A laminated veneer hammerboard for a drop forge press comprised of a series of plies of hard, high density wood preferably of the order of a peeled hard maple veneer with the grain of at least most of said veneer plies running along its length, each of said plies of the hammerboard having a thickness in the range of 1/32" to 3/16", and glue deposited between the plies securing the plies together and providing a relatively large number of hard glue surfaces enhancing the wearability of the board, said plies having opposite vertical edges positioned for edgewise engagement with lift rollers on a drop forge press.

16 Claims, 6 Drawing Figures

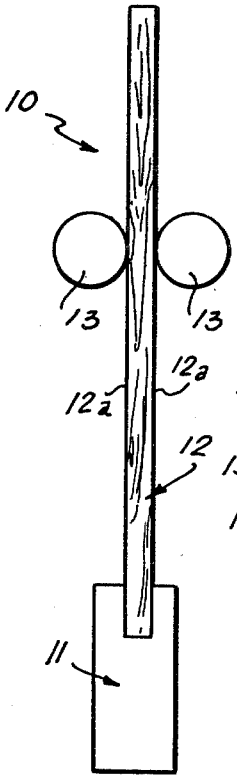
Fig. 1
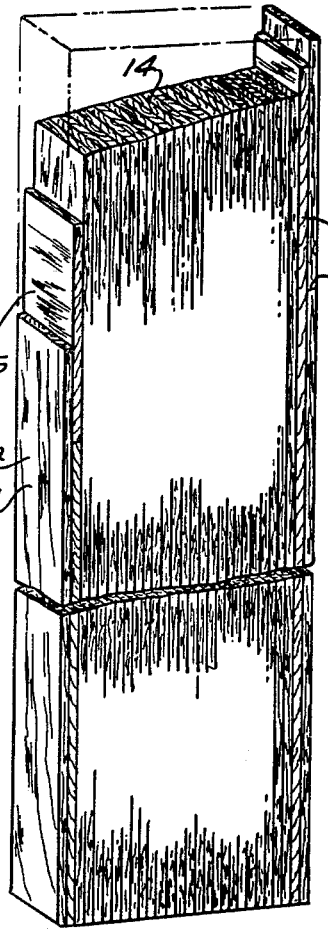
Fig. 2
Fig. 3
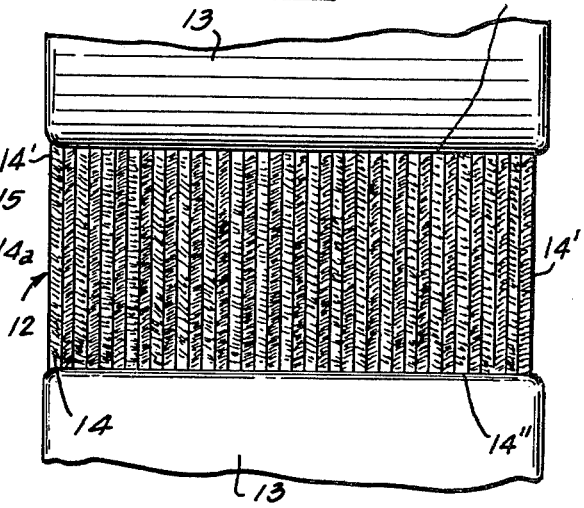
Fig. 5
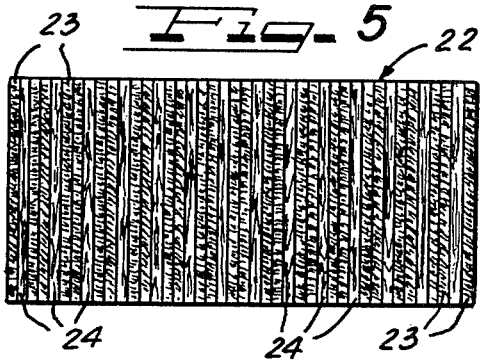
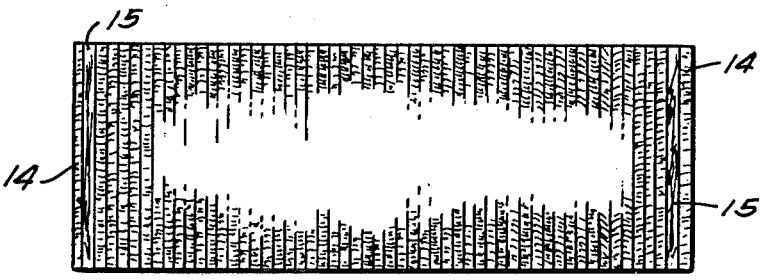
Fig. 4
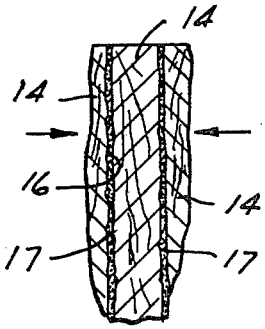
Fig. 6

LAMINATED BOARD AND HAMMER COMBINATION FOR A DROP HAMMER FORGE

BACKGROUND OF THE INVENTION

The present invention relates to a new and improved hammerboard for a drop forge press. More particularly the invention concerns a laminated plywood hammerboard comprising a series of very thin plies of hard, high density wood veneer with the grain of each ply of veneer running along its length, each ply having non-sawed peeled opposed surfaces providing glue surfaces thereon. The plies of the hammerboard are of a relatively thin construction and glue is disposed on the surfaces to secure each of the plies together to provide a new and improved manner.

Drop hammerboards are used in a common type of drop hammer forge. They are widely used in the forging industry throughout the world with heavy concentrations in the upper Midwest.

Specifically, a drop hammer forge has a stationary die and a moving die. This moving die is fastened onto a large weight (hammer) which is pulled up and then falls free onto the stationary die. One end of the drop hammerboard is clamped onto the hammer and the other end extends straight up between two rollers. These rollers clamp the board and pull the hammer assembly up. The rollers then release and allow the hammer to fall. There is also a brake to hold the board and hammer in the up position.

Present construction of boards: Boards are now made of hard maple lumber. Either one piece or several pieces laminated together. One variation is a layer of leather glued in. The approximate sizes used range from 1¼" to 2 1/16" thick, 7' to 15' long, and 3" to 12" wide.

Problems with present boards: The boards are subject to extreme shocks when the hammer hits bottom. They frequently break before they are worn out with estimates of premature breakage running upwards of 50%. Another problem is that the rollers wear the boards out, with the time dependent on the particular shape being forged. These problems lead to frequent shut downs to replace broken and worn boards and some danger to personnel with the flying pieces.

Our solution is to manufacture these boards from hard wood veneer having the grain oriented so as to extend the length of the board in one preferred embodiment. We start by cutting hard maple logs into veneer 1/32" to 3/16" thick and then we glue this veneer back together into panels of the proper size for drop hammerboards. This process allows us to engineer the boards to reduce or eliminate the breakage and improve the wearing properties.

In hammerboards, the laminated lumber construction has been known for many years. The newly developed preferred hard wood veneer type laminated hammerboard as herein disclosed has been found to work in a much improved manner over anything previously known to have been used and the life of such a board has been found to greatly exceed the useful life of other hammerboards used just before this invention. Laminated lumber hammerboards are formed from sawed layers as distinguished from the peeled layers of veneer used on our new board.

In view of the improved characteristics of the herein disclosed hard wood veneer type laminated hammerboard, an important object of this invention is to provide a hammerboard construction that has a life expectancy far exceeding any other known hammerboard, and to reduce down time for the user.

Another object of this invention is to provide a hammerboard construction that can be manufactured at least in part with known manufacturing procedures, and in such a way that the hammerboards can be produced on a production basis to satisfy the needs of the marketplace.

Another object of this invention is to provide a new and improved method of manufacturing hammerboards having peeled layers.

Still a further object of this invention is to provide a new and improved laminated plywood hammerboard comprised of a series of very thin hard, high density wood material with the grain of each ply of the veneer running along the length of the hammerboard and with glue being disposed on the surfaces provided in peeled surfaces of each ply, thus providing a tough bond and a hammerboard that has a life expectancy far exceeding any previously known hammerboards.

According to an important feature of this invention, we have provided a laminated plywood hammerboard for a drop forge press comprised of a series of plies of hard, high density wood maple veneer with the grain of at least most of said plies running along its length and with each of the plies having a thickness in the range of 1/32" to 3/16", and glue being deposited between the plies securing the plies together and providing a relatively large number of hard glue surfaces enhancing the wearability of the board.

Other features of the present invention relate to providing different types of hammerboards, at least one of which has a useful life of 472 hours by first using the board with one end attached to a hammer on a drop hammer forge and then by rotating the board 180 degrees and reattaching the opposite end of the board to the hammer for another period of use.

Still, other features of this invention relate to providing a hammerboard where most of the plies have a grain structure such that the grain structure runs the length of the hammerboard, but also where a selected number of the plies has a cross-grain structure at right angles to the longitudinally extending grain of the other plies to provide a tougher hammerboard construction that can hold up for longer periods of use.

Yet, another feature of this invention is to provide a hammerboard construction comprised of a series of plies where the plies have opposite edges so disposed that rollers on the drop forge press can engage directly against the opposite edges of the plies so that the useful life of the hammerboard can be prolonged as long as possible.

Other objects, features and advantages of the invention will be readily apparent from the following description of representative embodiments thereof taken in conjunction with the accompanying drawing although variations and modifications may be effected without departing from the spirit and scope of the novel concepts embodied in the disclosure and in which:

FIG. 1 is a diagrammatic view of the combination of a new and improved hard wood veneer type hammerboard and a ram for a drop forge press;

FIG. 2 is a fragmentary perspective view in full and dotted lines of a preferred embodiment of our new laminated veneer hammerboard illustrated in FIG. 1 with a spaced pair of the layers having transversely extending grain structure;

FIG. 3 is an enlarged fragmentary top plan view of a hammerboard of the type shown in FIG. 2 with the rollers engaged against edge surfaces of the layers of veneer, the hammerboard being of a type with a grain longitudinally extending along the length thereof;

FIG. 4 is a top plan view of the hammerboard shown in FIG. 2;

FIG. 5 is a top plan view of a modified type of hammerboard where certain laminations have grain structure disposed at right angles to grain structure of other laminations and with all laminations comprised of veneer; and FIG. 6 is an enlarged fragmentary view illustrating the rough edges of the veneer laminations and the manner of cooperation of the glue therein for securing the laminations in assembly.

In FIG. 1, the reference numeral 10 diagrammatically illustrates a drop forge press. This press may be of any suitable type. A number of issued U.S. patents generally relate to this subject and attention is directed to typical U.S. Pat. Nos. 2,204,222; 2,604,071 and 3,080,778, among others.

In FIGS. 1, 2, 3, 4 and 6, is illustrated a particular type of laminated hammerboard where each laminate is comprised of hard, high density wood veneer. As illustrated in FIG. 1, the hammerboard 12 has opposite sides 12*a*,12*a* which are adapted to be engaged by a pair of lift rollers 13,13 which when operated serve to elevate the ram 11 and when the rollers are released at a predetermined height, gravity operates to cause the ram to strike an anvil to cause parts to be forged. The hammerboard 12 is comprised of a series of veneer laminations 14 where the grain of each lamination or ply runs along the length of the hammerboard. The common plywood construction is such that the plywood is comprised of a series of plies and where the plies are disposed on top of one another with one ply having its grain structure running in one direction and with the next ply having its grain structure running at right angles and with the succeeding ply having its grain structure running in the same direction as the first mentioned ply. As shown in FIGS. 2 and 4, spaced one ply inboard of each end of the hammerboard 12 is a cross-grain ply 15 where the grain runs at right angles to the direction of the grain in the laminations 14.

Peeled surfaces 16 of the plies 14 are glued (FIG. 6) at 17 and it will be noted that the glue lines extend outwardly to the wear surface of the board so as to coact with the rollers 13,13.

Field tests have been run by users of hammerboards. One user, employing a new hammerboard press, has run a hammerboard of the type shown in FIG. 2 for 472 hours. This extended life is contrasted with old type hammerboards of other constructions that are being marketed by other manufacturers and which have been tested and found to have a useful life of only 27 hours. It is thus believed that the new and improved results of the herein disclosed hammerboards are definitely superior to any known prior art hammerboard. In this respect, it will be noted that the hammerboard shown in FIG. 2 is of the type where the rollers engage the opposite ends of the plies or against side grain wood as opposed to being engaged against face grain wood. The boards tested and shown in the figures were dimensioned so as to be 1½ inches in thickness, 8 feet in length and 3 to 4 inches in width.

As previously mentioned, where boards of the type shown in FIG. 3 are manufactured, some difficulty has been encountered since the top few layers of veneer tend to split.

It is believed that where a few cross-grain plies are used such as in the hammerboard shown in FIG. 2, that the splitting problem can be avoided or at least minimized.

It will thus be seen from FIG. 2 that the plies have vertical edge surfaces or faces or edges 14′ extending vertically and disposed at the width of the hammerboard as opposed to be located at opposite ends so that the rollers on a hammerboard press can engage opposite edges 14″ of said plies (FIG. 3).

Shown in FIG. 5 is a modified type of hammerboard. This hammerboard is essentially identical to the one shown in FIGS. 2, 3, 4 and 6, except a fewer number of plies 23 having a grain structure running the length of the hammerboard are employed and a greater number of cross-grain plies or laminations 24 are utilized. In this embodiment certain of the plies have its grain disposed at right angles to the longitudinal direction of the grain with respect to other of the plies and with the cross-grain plies being disposed at spaced intervals and interspersed amongst those plies having their grain structure extending longitudinally of the hammerboard.

As shown in FIG. 2, the plies 14 and 15 are each comprised of a series of pieced-together ply sections or plies with associated sections or plies having edges disposed in edge-wise-abutting relation as indicated at 14*a* and 15*a*. Thus, each of the butt-engaged plies or sections that are associated extend generally in a common plane. The hammerboard illustrated in FIG. 5 can be manufactured with pieced-together plies in the same manner as illustrated in FIG. 2, if desired.

Method of Manufacture

The present invention also involves a new and improved method of manufacturing hammerboards for the drop hammer forge industry.

The hammerboard described herein is manufactured from wood veneer rather than laminated lumber. The improved, newly discovered drop hammerboard is a laminated plywood board and has properties that are unique from the lumber board.

Our process starts with veneer logs. In a preferred embodiment hard maple is used because the forging industry has used it for years; it is readily available throughout the eastern U.S. and Canada; it has superior wearing and hardness characteristics, and we are skilled in its use. There are other woods that may work as well because of the internal reinforcement available in our hammerboard, but we have not had the opportunity to test them yet.

A list of suggested woods and comparisons of their strength has been taken by us from the U.S. Department of Agriculture Handbook, No. 72, printed in 1955. The handbook does not go into detail on how these tests were performed so the numbers listed are only good for comparisons within each table. Other woods with similar strengths could be suitable, but further testing would be required. The reinforcement available with glues and the interlocking grain may make some of the slightly softer woods worth testing. The aforesaid handbook reports as follows:

| Toughness, Table 14 Extract | Radial | Tangential |
|---|---|---|
| Yellow Birch | 260 | 330 |
| Elm, Winged | 350 | 360 |

-continued

| | | |
|---|---|---|
| Elm | 250 | 290 |
| Maple, Sugar | 190 | 190 |
| Oak, Pin | 230 | 220 |

| Strength properties, Table 12 Extract | Shear(13) | Hardness (16) |
|---|---|---|
| Maple, Sugar | 2330 | 1450 |
| Ash, White | 1950 | 1320 |
| Birch, Yellow | 1880 | 1260 |
| Elm, Cedar | 2240 | 1320 |
| Elm, Winged | 2370 | 1540 |
| Elm, Rock | 1920 | 1320 |
| Red Oak, Northern | 1780 | 1290 |
| White Oak | 2000 | 1360 |

| Machining Properties Table II Nail Splitting % Free from Defects | |
|---|---|
| Ash | 65 |
| Beech | 42 |
| Birch | 32 |
| Elm | 80 |
| Hickory | 35 |
| Hard Maple | 27 |
| Soft Maple | 58 |
| Red Oak | 66 |
| White Oak | 69 |

The hard maple logs are first heated in a steam room, pond, or in some manner that will warm the log. This softens the wood and makes it more flexible. Next, the bark is removed because it is usually full of sand and dirt that will dull the cutting knife. The veneer cutting is usually done with a knife. Veneer can be cut with a saw but it would be very wasteful and expensive. Preferably, the veneer is cut on a rotary lathe which, in our opinion, has certain economic advantages, but there are other methods of cutting veneer such as slicing and halfrounding which would produce useful veneer. A rotary lathe consists of a long knife against which the log is rotated, the log being clamped to the lathe. This process peels off a continuous thin layer of veneer from around the circumference of the log. The process is continued until most of the log is converted into veneer. As the continuous sheet comes off the lathe, it is clipped into pieces for easier handling. The good logs without serious defects are clipped into whole sheets so they can go to the press after drying with only minor trimming. Any veneer with unallowable defects is clipped so it is free of such defects. The clipped sheets are smaller than full sheets, and we call them random width sheets. These random width sheets will be spliced back together so they are full sheet size after they are dried. The veneer is dried to 6%–8% moisture content in a conventional veneer dryer. The random width sheets are spliced into whole sheet sizes, then treated like whole sheets are after drying. Splicing is just fastening narrow sheets of veneer together to make a full width sheet. We splice with glue but tape or thread can be used or any technique that will join the veneer.

The next step of manufacture employs a layup table. First, a dry sheet of veneer is put on the table, then a sheet is run through a glue spreader and glue is applied to both sides (wet sheet). The glue can be applied many different ways. What is important is that a proper spread of glue is put between each sheet of veneer. This wet sheet is placed on the dry sheet and the procedure is repeated . . . wet sheet, dry sheet, wet sheet, dry sheet . . . until sufficient thickness is reached. In this layup all the veneer runs the same way (parallel laminate) but minor variations in grain direction within the veneer will, when glued together, interlock to prevent splitting of the panel.

Excellent results have been obtained using R-14 Resorcinol glue from National Casein which is commercially described as a modified resorcinol-formaldehyde adhesive. We apply this glue in a glue spreader at 50# per MSF (thousand sq.ft.) double glue line. The center of the panel needs to achieve 180°–190° F. to cure this glue. An expert could also use formulas with phenolic resins and caseins. In any case, the procedure would need to be modified to suit the formula.

The bundle of dry and wet sheets is pushed into a press, squeezed together, then the glue is allowed to cure. A press with live steam in the platens can be successfully used. This heats the panel and speeds up the curing process. Electronics can also be used to heat the glue to speed curing or use a glue that will set at room temperature. Our 12′ hot press is heated to 300° F. and presses at 250 to 300 PSI until the glue is set. This process allows us to make large blanks which may be sawed up into the individual hammerboards.

We usually make up wide blanks to the proper thickness and length and then saw the correct widths out of this blank.

| Thick | | Wide | | Long |
|---|---|---|---|---|
| 1¼″ | × | 4″ | × | 96″ |
| 1¼ | | 3 | | 96 |
| 1¼ | | 4 | | 144 |
| 1¾ | | 4 | | 144 |
| 1¼ | | 4 | | 120 |

Thicknesses commonly range from 1¼″ to 2″; widths from 3″ to 8″; and lengths from 8′ to 16′.

The board is composed of many thin layers of veneer with R-14 "Resorcinol" glue line or layer between each ply. It is sawed in such a way that the rollers run on the side of each glue line. The glue penetrates the wood, filling voids and locking the fibers together. In effect, it appears that each layer of this glue provides a tough, durable finish. It appears that the R-14 "Resorcinol" glue penetrates each sheet of veneer on each side with glue from 3 to 5 thousandths of an inch and in some cases the glue penetrates much further. In a 3-inch wide board, we have 42, R-14 "Resorcinol" glue lines and if we have a total of 10 thousandths of an inch of tougher and more wear resistant wood for each R-14 "Resorcinol" glue line, we have 420 thousandths of an inch of this wood on which the rollers can run as compared to conventional glue lines of about 20 thousandths of an inch on a conventional laminated lumber board. In the 4″ board, we have 56, R-14 "Resorcinol" glue lines or approximately 560 thousandths of an inch, over ½ inch of this is tougher and more resistant hard glue laddened wood.

The primary difference that should be pointed out with these boards is that they are made out of veneer and not lumber. The processes of manufacturing veneer and lumber and pressing them into boards is different in many phases and results in wood products with different characteristics. These individual characteristics can be used separately or in combination to make the panel or board to meet your needs. The logs to be veneered must be heated whereas the logs to be sawed are left cold. Cutting veneer uses a knife. Sawing lumber uses a saw. Veneer is dried in a veneer dryer and lumber is dried in a dry kiln. Lumber is pressed in a press with side pressure and veneer is pressed in a press with top pressure. So, almost all stages of the manufacturing process are different.

Using veneer leads to a superior hammerboard. In a lumber hammerboard, a knot or a small patch of short grain usually results in a broken board and lost production on the forge. A veneer board uses small knots, cross grain, and grain variation to increase its strength. By turning every sheet of veneer, we take advantage of these variations. Each layer reinforces the one next to it. The entire board is internally reinforced making it much stronger than the average lumber board.

If thin veneer is used, the glue will go into the pores and cracks of each sheet. This reinforces the wood fiber and helps interlock each layer together. The interlocking between veneer layers makes the board stronger decreasing board breakage. The reinforcing of wood fiber helps to increase wear resistance of the board. These two factors result in a stronger board that lasts longer. The reduced down time on the drop hammer forge because of these factors results in a significant advantage to the forging industry.

These boards are significantly different from the laminated lumber boards in that: (1) They are made out of wood veneer and not lumber. (2) This wood veneer uses production processes and equipment that is unique from lumber but standard in the plywood industry. (3) The boards made from wood veneer are internally reinforced by the grain of the wood and the glue in ways that are not readily available to the lumber boards. (4) The veneer boards have a significantly greater life expectancy due to reduced breakage and greater wear resistance. (5) The use of veneer allows inclusion of lower grade wood and eliminates saw kerf thus resulting in more efficient utilization of the wood fiber used in them. (6) The drop hammer forge industry has been seeking an answer to their board problem for many years. These boards are part of the answer. Our laminated veneer hammerboards help cut one of the largest expenses of the least energy demanding forging techniques.

There are a great many thicknesses of veneer that would work and as many layups for putting them together. Two of the factors that must be considered when choosing a thickness are: (1) availability in the market, and (2) compatability with other veneer used in the plant.

Some advantages of thick veneer:

1. Fewer pieces to handle saves labor.
2. Fewer pieces in boards saves glue lines.
3. Fewer glue lines means less water and fewer steam blows.

Some disadvantages of thick veneer:

1. Harder on machinery—may need special machinery.
2. More lathe checks and rougher cutting means reduced strength.
3. More difficult to splice and clip.

Some advantages of thin veneer:

1. Easier on machinery.
2. Easier to splice, etc.
3. Fewer and smaller lathe checks, smoother cut veneer.
4. Glue reinforces larger percentage of the wood.

Some disadvantages of thin veneer:

1. More pieces to handle (more labor).
2. Uses more glue.
3. Moisture form the glue causes steam blows.

After considering the above factors, we chose 1/14" veneer because it is compatible with our other products. Other thicknesses would work and we could easily switch.

Typical layup for 3" panel—use different layups for other thicknesses:

43 layers 1/14" (FIGS. 2, 3, 5, 6) for 3" width board;
57 layers 1/14" (FIG. 4) for 4" width board.

All grain to run in long direction.

All the grain runs the same way (parallel laminate) and we allow 1" knot holes and small splits on the interior plies. The outside layers should be sound. No rot, doze (form of wood rot and it makes wood soft), or similar defects allowed unless less than 1" in diameter. For boards that are longer than the veneers available we butt join the veneer together to make the necessary length. Care should be taken so that joints do not coincide without five or six layers between. Another method of joining such as scarf joining would be beneficial. The above described hot press procedure and the state of technology of this art does not presently allow veneers to be cut having a thickness much less than 1/32". It has also been found that where the amount of glue has been increased, that the hammerboard produced is stronger.

We claim as our invention:

1. In a drop forge hammerboard press having lift roller means and a hammer, a hammerboard attached at one end to the ram and engageable at an opposite end with the lift roller means, the improvement comprising the hammerboard being comprised of a series of plies of hard, high density wood at least of the order of hard maple veneer with the grain of at least most of said veneer plies running along its length, each of said plies of the hammerboard having a thickness in the range of 1/32" to 3/16", and glue deposited between the plies securing the plies together and providing a relatively large number of hard glue surfaces enhancing the wearability of the board, said plies having opposite vertical edges extending vertically and disposed along the width of the hammerboard as opposed to being located at opposite ends so that the rollers on a hammerboard press can engage said opposite vertical edges of each of said plies.

2. The hammerboard press of claim 1 further characterized by certain of the plies having its grain being disposed at right angles to the longitudinal direction of the grain with respect to the other plies and with the cross-grain plies being disposed at spaced intervals and interspersed amongst those plies having their grain structure extending longitudinally of the hammerboard.

3. The hammerboard press of claim 1 further characterized by a pair of the plies having grain structure disposed at right angles to the longitudinally extending grain structure of the other plies and with this pair of so-called cross-grained plies being disposed one ply spaced from outer opposite ends of the hammerboard and with all of the plies being so oriented that opposed edges of the plies extend along the width of the hammerboard rather than along the opposite ends of the hammerboard.

4. The hammerboard press of claim 1 further characterized by at least certain of said plies each being comprised of a series of pieced-together ply sections with associated sections having edges disposed in edgewise abutting relation and with each of the thus associated sections extending in a common plane.

5. The hammerboard press of claim 1 further characterized by having its hard density maple veneer grain structure so oriented as to have a useful life of roughly 470 hours by first using the board with one end attached to the hammer and after a period of use rotating the board 180° and reattaching the opposite end of the board to the hammer for another period of use.

6. The hammerboard press of claim 1 further characterized by said plies each having a thickness of 1/14" and said hammerboard having 14 thin layers per inch with there being 43 thin layers on a 3" board and 57 thin layers on a 4" board and with hard wearing glue lines between the layers and along the roller-engaging surfaces thereof.

7. The press of claim 1 further characterized the plies being glued together with a glue known as R-14 "Resorcinol" glue.

8. The hammerboard press of claim 1 characterized by utilizing a glue known as a modified resorcinol-formaldehyde adhesive or glue.

9. The hammerboard press of claim 1 further characterized by said hammerboard being 3 inches wide and having 42 glue lines having an aggregate of 420 thousandths of an inch of glue line on which the rollers can run when engaged against opposite edges of each ply disposed along the width of the board.

10. The hammerboard press of claim 1 further characterized by said hammerboard being 4 inches wide and having 56 glue lines having an aggregate of 560 thousandths of an inch of glue line on which the rollers can run when engaged against opposite edges of each ply disposed along the width of the board.

11. The hammerboard of claim 1 further characterized by said hammerboard having 14 thin plies per running inch of the hammerboard and approximately the same number of hard glue lines therebetween.

12. The hammerboard of claim 1 further characterized by the plies having a thickness of 1/14" and said hammerboard having 14 thin layers per inch with there being 43 thin layers on a three-inch board and 57 thin layers on a four-inch board and with hard wearing glue lines between the layers or plies extending along the roller engaging surfaces thereof.

13. The hammerboard of claim 1 further characterized by said board having 42 glue lines having an aggregate of 420 thousandths-of-an-inch of glue line on which the rollers can run when engaged against opposite vertical edges of each ply disposed along the width of the board.

14. The hammerboard of claim 1 further characterized by said board having 56 glue lines having an aggregate of 560 thousandths-of-an-inch of glue line on which the rollers can run when engaged against opposite vertical edges of each ply disposed along the width of the board.

15. A laminated veneer hammerboard for a drop forge press comprised of a series of plies of hard, high density wood of the order of a peeled hard maple veneer with the grain of at least most of said veneer plies running along its length, each of said plies of the hammerboard having a thickness in the range of 1/32" to 3/16", and glue deposited between the plies securing the plies together and providing a relatively large number of hard glue surfaces enhancing the wearability of the board, said plies having opposite vertical edges extending vertically and disposed along the width of the hammerboard as opposed to being located at opposite ends so that rollers on a hammerboard press can engage said opposite vertical edges of each of said plies, said board having 42 glue lines having an aggregate of 420 thousandths-of-an-inch of glue line on which the rollers can run when engaged against opposite vertical edges of each ply disposed along the width of the board.

16. A laminated veneer hammerboard for a drop forge press comprised of a series of plies of hard, high density wood of the order of a peeled hard maple veneer with the grain of at least most of said veneer plies running along its length, each of said plies of the hammerboard having a thickness in the range of 1/32" to 3/16", and glue deposited between the plies securing the plies together and providing a relatively large number of hard glue surfaces enhancing the wearability of the board, said plies having opposite vertical edges extending vertically and disposed along the width of the hammerboard as opposed to being located at opposite ends so that rollers on a hammerboard press can engage said opposite vertical edges of each of said plies, said board having 56 glue lines having an aggregate of 560 thousandths-of-an-inch of glue line on which the rollers can run when engaged against opposite vertical edges of each ply disposed along the width of the board.

* * * * *